US005094416A

United States Patent [19]

Huon

[11] Patent Number: 5,094,416

[45] Date of Patent: Mar. 10, 1992

[54] SLIDING SUPPORT TO FACILITATE THE DISPLACEMENT OF LOADS AND IN PARTICULAR ITEMS OF FURNITURE

[75] Inventor: Louis Huon, Paris, France

[73] Assignee: Societe Said: Erels Distribution, Paris, France

[21] Appl. No.: 557,888

[22] Filed: Jul. 25, 1990

[30] Foreign Application Priority Data

Jun. 28, 1990 [FR] France ..... 90 08159

[51] Int. Cl.[5] ..... A47B 91/00

[52] U.S. Cl. ..... 248/188.8; 248/346.1

[58] Field of Search ..... 248/188.8, 188.9, 188.91, 248/346.1, 501, 502

[56] References Cited

U.S. PATENT DOCUMENTS 1,861,095 5/1932 Schacht ..... 248/346.1
1,903,690 4/1933 Schacht ..... 248/346.1
1,969,266 8/1934 Herold ..... 248/346.1
3,326,508 6/1967 Born ..... 248/346.1

FOREIGN PATENT DOCUMENTS 4073 of 1888 United Kingdom ..... 248/188.8

*Primary Examiner*—Carl D. Friedman
*Assistant Examiner*—Korie H. Chan
*Attorney, Agent, or Firm*—Seidel, Gonda, Lavorgna & Monaco

[57] ABSTRACT

A sliding support to facilitate the displacement of loads and particularly items of furniture is disclosed. The sliding support comprises a cup-shaped member of synthetic material adapted to come in contact with the ground. The cup-shaped member contains an elastomeric body adapted to support the load which is to be displaced. The sliding support further comprises a plug-shaped member which is removably housed in an approximately correspondingly shaped recess provided in the elastomeric body.

7 Claims, 1 Drawing Sheet

SLIDING SUPPORT TO FACILITATE THE DISPLACEMENT OF LOADS AND IN PARTICULAR ITEMS OF FURNITURE

BACKGROUND OF THE INVENTION

The invention relates to means for moving heavy items and, more particularly, to a sliding support which facilitates the displacement or movement of bulky items such as furniture.

Commonly, it is necessary to move heavy loads, such as furniture or other bulky items. The movement, more than likely, involves laborious effort primarily caused by the bulky item contacting the ground as it is moved from place to place. It is desired that means be provided to facilitate such movement, especially, to facilitate the movement of the bulky items along the ground.

It is a common occurrence that the bulky items, such as furniture, may be moved on a periodic basis. Each such movement commonly involves first gathering up the necessary means to facilitate such movement. It is desired that some of the means for movement be conveniently attached to the items to be moved so as to more readily facilitate this periodic occurrence.

Accordingly it is an object of the present invention to providing a sliding support to facilitate the movement of bulky items such as furniture. The sliding support comprises a cup-shaped member of synthetic material adapted to come in contact with the ground and which contains an elastomeric body to support the load as it is being moved.

Another object is to provide a sliding support having as a characteristic feature one in which the support of the load is accomplished by a plug-like member of synthetic material intended to be fixed under the load to be displaced. This plug-like member is removably housed in a correspondingly shaped recess provided in the elastomeric body.

A still further object is to provide a sliding support having, as another characteristic feature, an elastomeric body which comprises grooves on its surface.

Further, another characteristic feature of the sliding support of the invention is that the plug-like member is provided with annular ribs and/or grooves which are accommodated in corresponding grooves and/or ribs in/on the elastomeric body.

SUMMARY OF THE INVENTION

The present invention relates to the provision of a support which forms a sliding shoe which is adapted to be rapidly and easily positioned under a load in order to allow it to be more readily moved. The construction of the shoe being such that it slides easily on the ground even if the ground is not strictly flat and smooth, whereas on the other hand it resists displacement of the load which it is supporting. Similarly, this construction of the shoe is such that it can be placed in position under the load which is to be moved whatever the nature of the load and more particularly, if the load is an item of furniture provided with feet, whatever the dimensions of the feet.

This device of the present invention consists of a cup-shaped member made from relatively hard and sliding synthetic material; for example, polytetrafluoroethylene, on the inside of which there is disposed an elastomeric body which is therefore a body which is not readily adapted to slide. This elastomeric body entirely fills the cup-shaped member so that its upper surface is flush with the edge of the cup-shaped member. Fitting the elastomeric body into the cup-shaped member could be carried out by gluing, but also in an operation of over-moulding of the elastomeric body in the cup-shaped member.

Other objects. advantages and novel features of the present invention will become apparent from the following detail description of the invention when considered in conjunction with the accompanying drawings.

BRIEF DESCRIPTION OF THE DRAWINGS

For the purposes of illustrating the invention, there is shown in the drawings a form which is presently preferred; it being understood, however, that this invention is not limited to the precise arrangements and instrumentalities shown.

DETAILED DESCRIPTION OF THE PREFERRED EMBODIMENT

Figure 1:
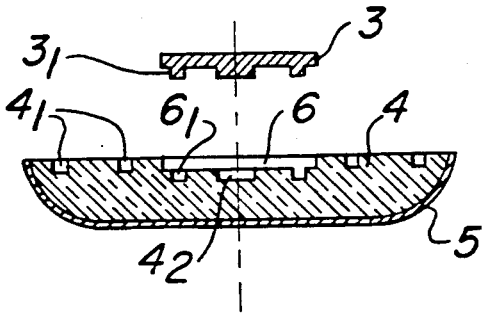
FIG. 1 is a sectional view of an embodiment of a support comprising,.a fixing plug which is locatable under the load to be displaced.
Figure 2:
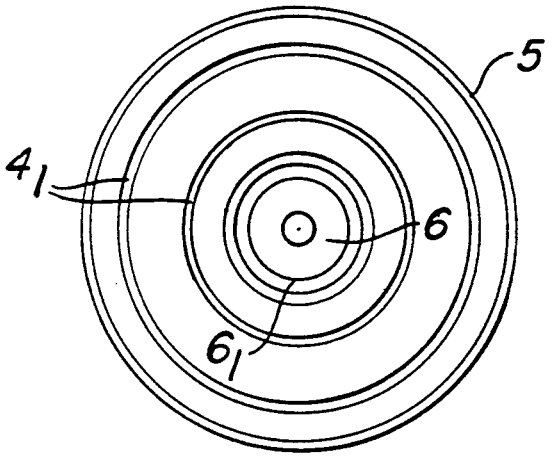
FIG. 2 is a plan view of one of the elements in FIG. 3.

In accordance with the embodiment shown by way of example in FIGS. 1 and 2, the support provide by the present invention is intended to carry the load, for example, furniture, which is to be displaced or moved through the intermediary of a preferably circular removable plug-shaped member 3.

The elastomeric body 4, disposed in the cup-shaped member 5, comprises, in this case, a housing 6 which in shape and size corresponds to the plug-shaped member 3.

In particular, the height of the plug-shaped member 3 preferably corresponds to the depth of the housing 6, so that after assembly, the upper surface of member 3 is disposed at the level corresponding to the upper surface of the elastomeric body 4.

The plug-shaped member 3 and the housing 6 respectively comprise coaxial circular ribs and/or grooves $3_1$, $6_1$ in order to enhance the attachment of the plug-shaped member in the elastomer so reliably avoiding their relative displacement when a load is being displaced in relation to the ground.

In the example illustrated, the plug-shaped member 3 likewise comprises a central projection $3_2$ of a height which is slightly greater than that of the ribs/grooves $3_1$, this projection being housed in a corresponding central recess $6_2$ in the elastomer 4. It is in particular an object of this projection to facilitate the fitting of the plug-shaped member in its housing.

The plug-shaped member 3 is intended to be fixed under the load to be displaced by any means and, in particular, by means of a screw, a point or a rivet which traverses the center of the plug-shaped member. Similarly, fitting the plug-shaped member to be located under the load may be achieved by gluing and, in particular, by means of a double-sided adhesive.

In the embodiment shown by way of example in FIGS. 1 and 2, the elastomeric body comprises concentric grooves $4_1$ intended to improve the attachment of the load in so far as the load and, for example, the foot of an item of furniture which is to be displaced. For such an example, the foot is of a width greater than that of the plug-shaped member 3 which is situated in the elastomer 4.

It will be noted that the disposition according to the invention makes it possible to use plug-shaped members 3 of identical dimensions and cup-shaped members 5 of different dimensions in so far as the elastomer 4 of each of the cup-shaped members comprises a housing 6 of identical shape and dimensions for all the cup-shaped members and corresponding to those of the plug-shaped member 3.

Likewise, in this case, the elastomeric body 4 is preferably made by over-moulding on a sheet of synthetic material which is simultaneously moulded under heat in order to easily and rapidly obtain a rugged attachment of the elastomeric material in the cup-shaped member simultaneously with its forming.

Figure 4:
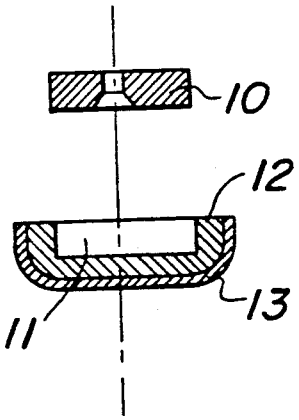
FIG. 4 is a cross-sectional view of another embodiment of the cup-shaped member and its plug-like member.

Likewise preferably, the rib $3_1$ (see FIG. 4) will comprise a rounded end 7 in order to facilitate its penetration into the corresponding groove $6_1$.

Likewise, the base 8 of the rib $3_1$ has a narrowed cross-section while the corresponding groove $6_1$ comprises a narrowed opening 9 in order to obtain a snap action of the plug-shaped member 3 into the body 4. Such a snap-action provision is provided while still maintaining the removable fitting of the member 3 to the elastomeric member 4.

Figure 3:
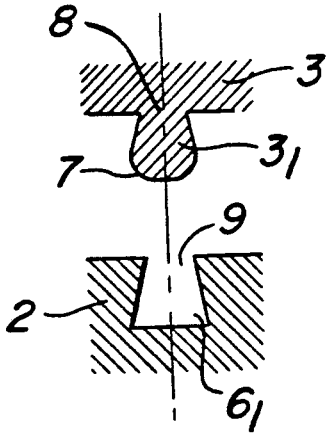
FIG. 3 is an enlarged sectional view of an embodiment of the ribs and grooves on the plug or on the cup-shaped member.

In the embodiment, shown by way of example in FIG. 3, the plug-shaped member 10 is made simply in the general form of a cylindrical flat disc which is removably placed in a correspondingly shaped housing 11 provided in the elastomeric body 12 which is fixed inside the cup-shaped member 13.

In this construction, as in that in FIG. 3, the elastomeric body 12 allows the cup-shaped member 13 at all times to adapt its angular position in relation to the plug-shaped member 10 in order to allow for unevenness of the ground. Likewise, it has the object of providing a flexible horizontal link between the cup-shaped member 13 and the plug-like member 10, this resilient link making it possible to favor sliding of the cup-shaped member on the ground. Finally, the elastomeric body 12, by virtue of its anti-slip properties, is intended to avoid the plug-shaped member 10 slipping in respect of the load which is to be moved, or displaced.

Likewise, in this example which is shown in FIG. 3 and also in the example shown in FIG. 1, the housing 11 and the plug-shaped member 10 could be provided with means such as bevels, ribs, projections, etc., which ensure axial retention of the elastomeric body on the plug-shaped member in order to avoid their untimely separation.

These means could likewise consist of magnetic means (not shown) provided on the plug-shaped member in the housing of the elastomeric body as well as the elastomeric body itself.

What I claim is:

1. A sliding support to facilitate the displacement of loads and particularly of items of furniture, comprising:

a cup-shaped member of synthetic material adapted to come in contact with the round, said cup-shaped member containing an elastomeric body adapted to support the load which is to be displaced, said elastomeric body having a shaped recess and a plug-shaped member of synthetic material adapted to be fixed under the load which is to be displaced, said plug-shaped member being removably housed in said shaped recess provided in said elastomeric body, said plug-shaped member and said elastomeric body being provided with annular ribs and grooves, said ribs and grooves of said plug-shaped member being respectively housed in corresponding groves and ribs of said elastomeric body, said ribs having top regions.

2. A support according to claim 1, wherein the ribs are of rounded shaped at their top regions.

3. A support according to claim 1, wherein the plug-shaped member further comprises means for retaining aid plug-shaped member with the shaped recess of said elastomeric body when said plug-shaped member is in its housed position.

4. A support according to claim 1, wherein the shaped recess of said elastomeric body further comprises means for retaining said elastomeric body with the plug-shaped member when said plug-shaped member is in its housed position.

5. A support according to claim 1, wherein the ribs have at their base a narrowed ross-section while the grooves have a narrowed cross-section at their opening.

6. A support according to claim 3, wherein the retaining means of said plug-shaped member are magnetic.

7. A support according to claim 4, wherein the retaining means of said shaped recess of said elastomeric body are magnetic.

* * * * *